US005726529A

United States Patent [19]

Dean et al.

[11] Patent Number: 5,726,529

[45] Date of Patent: Mar. 10, 1998

[54] SPACER FOR A FIELD EMISSION DISPLAY

[75] Inventors: Kenneth Dean, Phoenix; Ralph Cisneros; Kathleen Tobin, both of Tempe, all of Ariz.

[73] Assignee: Motorola, Schaumburg, Ill.

[21] Appl. No.: 656,993

[22] Filed: May 28, 1996

[51] Int. Cl.[6] ..... H01J 1/62; H01J 63/04; H01J 1/00; H01J 19/00

[52] U.S. Cl. ..... 313/495; 313/238; 313/243; 313/268; 313/292; 220/445; 220/447

[58] Field of Search ..... 313/238, 243, 313/250, 253, 254, 255, 256, 257, 258–59, 268, 274, 276, 284–86, 288–89, 292, 244–46, 266, 290, 309, 336, 351, 422, 495, 497; 220/445–47

[56] References Cited

U.S. PATENT DOCUMENTS

| | | | |
|---|---|---|---|
| 5,532,548 | 7/1996 | Spindt et al. | 313/495 X |
| 5,534,743 | 7/1996 | Jones et al. | 313/309 |
| 5,614,781 | 3/1997 | Spindt et al. | 313/422 |
| 5,629,583 | 5/1997 | Jones et al. | 313/309 X |

FOREIGN PATENT DOCUMENTS

| | | |
|---|---|---|
| 9321650 | 10/1993 | WIPO . |
| 9418694 | 8/1994 | WIPO . |
| 9420975 | 9/1994 | WIPO . |

*Primary Examiner*—Sandra L. O'Shea
*Assistant Examiner*—Mack Haymes
*Attorney, Agent, or Firm*—Eugene A. Parsons

[57] ABSTRACT

A spacer (200) for a field emission display (201) is disclosed. The spacer (200) includes a lower resistive region (220) and an upper insulative region (222). The spacer (200) has a member (210) which is coated with a resistive coating (212) extending between the lower end of the member and a height ($h_2$) less than the total height ($h_1$) of the spacer (200). An insulative coating (218) is formed on the member (210) and extends between the upper end of the resistive coating (212) and the upper end of the member (210). The resistive coating (212) has a secondary electron yield less than 2 over the lower resistive region (220) of the spacer (200). The insulative coating (218) has a secondary electron yield between 0.75–2 over the upper insulative region (222) of the spacer (200).

37 Claims, 7 Drawing Sheets

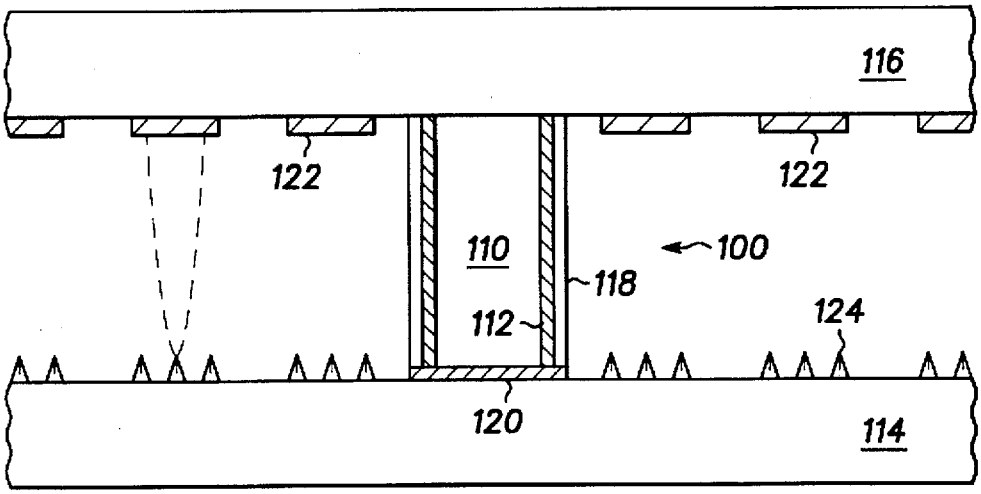
101 FIG. 1 - PRIOR ART -
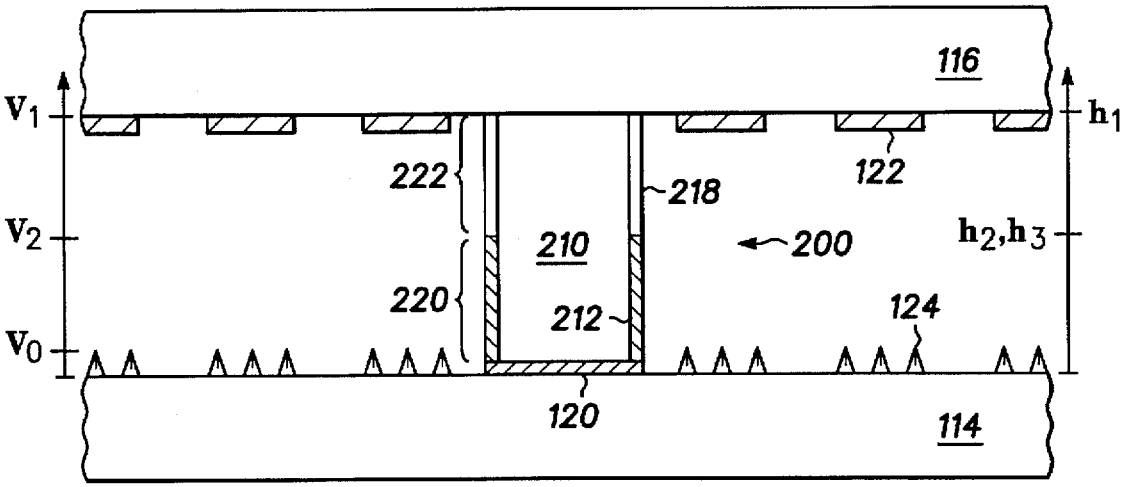
201 FIG. 2
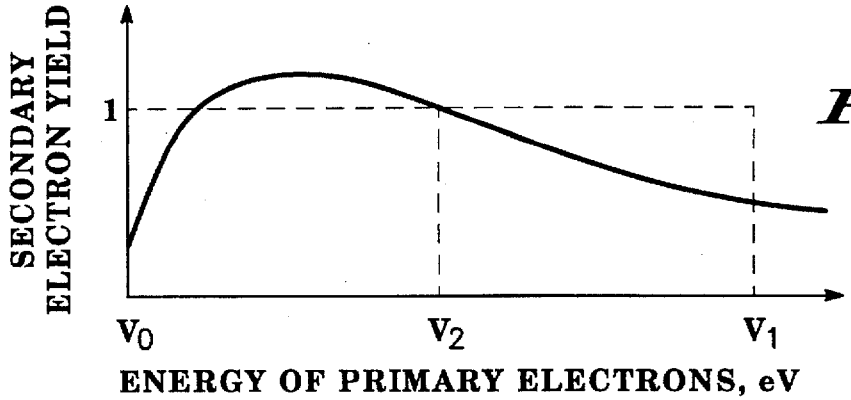
FIG. 3

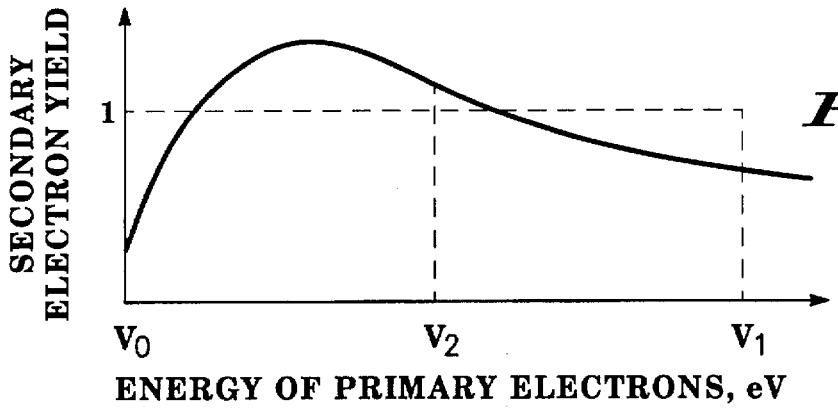
FIG. 4
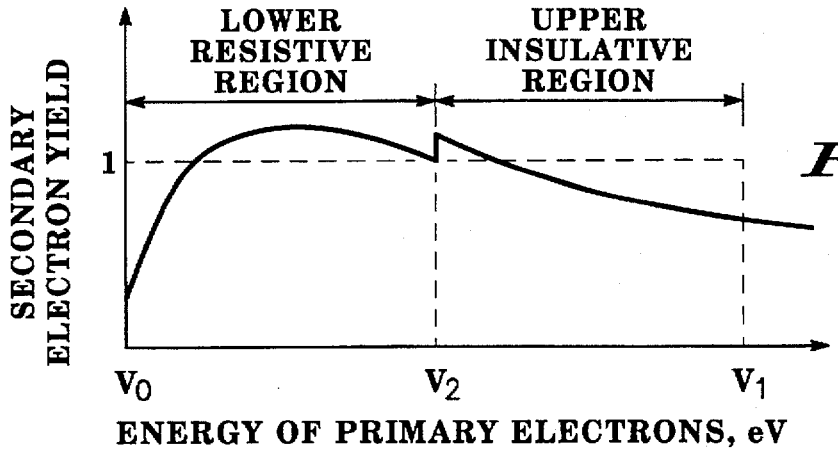
FIG. 5
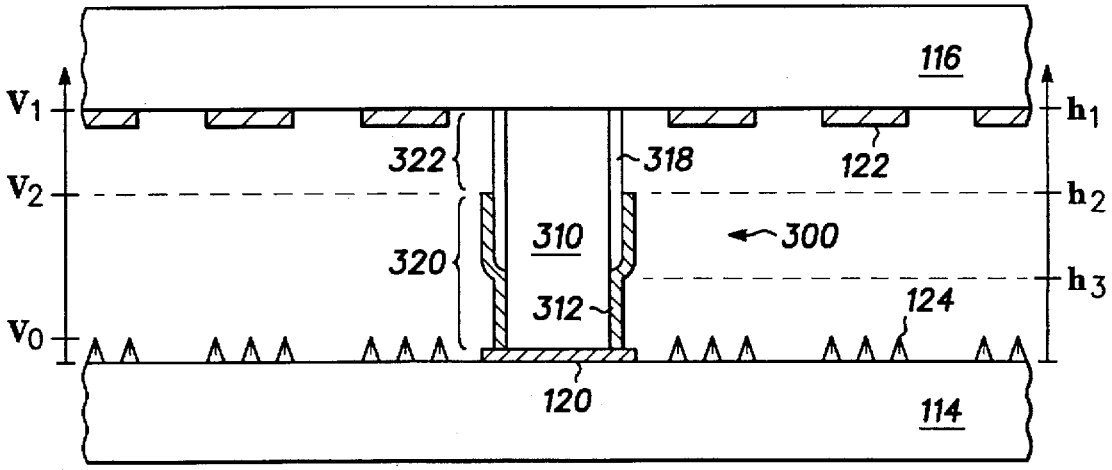
301 FIG. 6

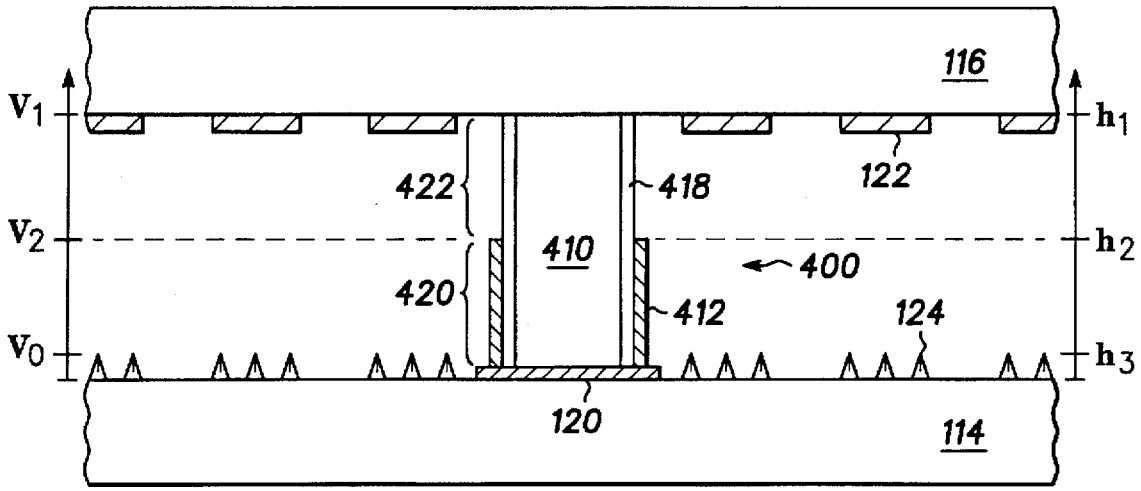
401 FIG. 7
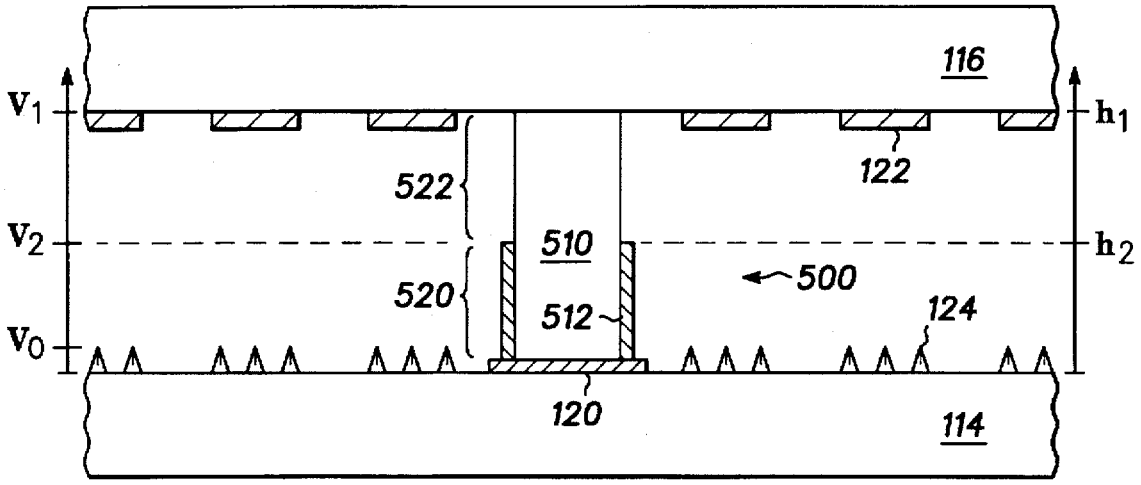
501 FIG. 8
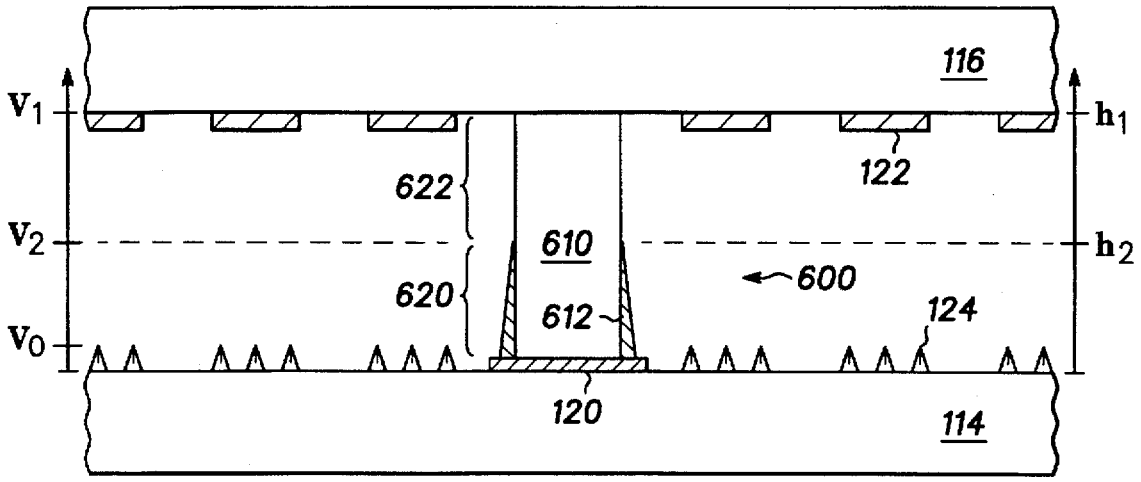
601 FIG. 9

-PRIOR ART-

50

-PRIOR ART-

SPACER FOR A FIELD EMISSION DISPLAY

FIELD OF THE INVENTION

The present invention pertains to spacers for field emission arrays and field emission displays and more specifically to a coated spacer which reduces secondary electron emission and spacer-related image distortions and power losses.

BACKGROUND OF THE INVENTION

Field emission arrays and displays are known in the art. They include an envelope structure having an evacuated interspace region between two display plates. Electrons travel across the interspace region from a cathode plate (also known as a cathode or back plate), upon which electron-emitter structures, such as Spindt tips, are fabricated, to an anode plate (also known as an anode or face plate), which includes deposits of light-emitting materials, or "phosphors". Typically, the pressure within the evacuated interspace region between the cathode and anode plates is on the order of $10^{-6}$ torr.

In order to provide a strong electric field (volts per unit distance between the plates) for extraction of electrons from the cathode plate, while maintaining low power consumption, the distance between the cathode and anode plate is small, on the order of one millimeter. This proximity of the plates introduces the problem of potential electrical breakdown between the electron emitting surface and the inner surface of the anode plate. Such an electrical breakdown effectively ruins the display.

The cathode plate and anode plate are thin in order to provide low display weight. If the display area is small, such as in a 1" diagonal display, and a typical sheet of glass having a thickness of about 0.04" is utilized for the plates, the display will not collapse or bow significantly. However, as the display area increases, the thin plates are not strong enough to withstand the pressure differential and prevent collapse or bowing upon evacuation of the interspace region. For example, a screen having a 30" diagonal will have several tons of atmospheric force exerted upon it. As a result of this tremendous pressure, spacers play an essential role in large area, light-weight displays. Spacers are structures being incorporated between the anode and the cathode plate. The spacers, in conjunction with the thin, lightweight, plates, support the atmospheric pressure, allowing the display area to be increased with little or no increase in plate thickness.

The anode plate is maintained at a higher potential relative to the cathode plate, thereby establishing an electric field between the display plates. The potential difference between the plates is on the order of kilovolts (kV). An electric field extracts electrons from the emitters on the cathode plate and the anode potential further accelerates the emitted electrons toward the phosphor deposits on the anode plate. To prevent shorting between the plates, a high-dielectric material is used to make the spacers. However, dielectric materials have secondary electron yields, or ratio of emitted secondary electrons to incident primary electrons, substantially different from one when subjected to bombardment by primary electrons having energies typical of those in a field emission display. This results in electrical charging of the spacer surface. The charged spacer surface alters the characteristics of the electric field near the spacers, thereby deflecting electrons and causing image distortions, such as color "bleeding".

Several schemes have been developed to address the charging of spacers within flat panel displays. In one scheme, a thin conductive coating, having a sheet resistance on the order of $10^9$–$10^{14}$ ohm/square, is formed on the entire outer surface of the spacer which is exposed to the vacuum environment within the display. The conductive coating allows the charge to be "bled off" to the cathode. This scheme suffers from the disadvantage that it creates a leakage from the anode to cathode, resulting in power losses. Other schemes have attempted to reduce power losses by providing additional electrodes along the spacer wall. This approach suffers from the disadvantages of increased fabrication complexity and increased fabrication cost.

Thus, there exists a need for a display spacer which exhibits reduced electrical charging at its surfaces, which reduces power losses within the display, and which is easily and economically fabricated.

BRIEF DESCRIPTION OF THE DRAWINGS

Referring to the drawings:

FIG. 1 is a cross-sectional view of a prior art spacer for a field emission display.

FIG. 2 is a cross-sectional view of an embodiment of a spacer for a field emission display in accordance with the present invention.

FIG. 3 is a graphical representation showing the relationship between secondary electron yield and the energy of primary, impinging electrons for a typical material comprising a resistive coating in accordance with the present invention.

FIG. 4 is a graphical representation showing the relationship between secondary electron yield and the energy of primary, impinging electrons for a typical material comprising an insulative coating in accordance with the present invention.

FIG. 5 is a graphical representation showing the relationship between secondary electron yield and the energy of primary electrons along the height of the spacer in accordance with the present invention.

FIGS. 6–10 are cross-sectional views of other embodiments of a spacer for a field emission display in accordance with the present invention.

DESCRIPTION OF THE PREFERRED EMBODIMENT

Figure 10:
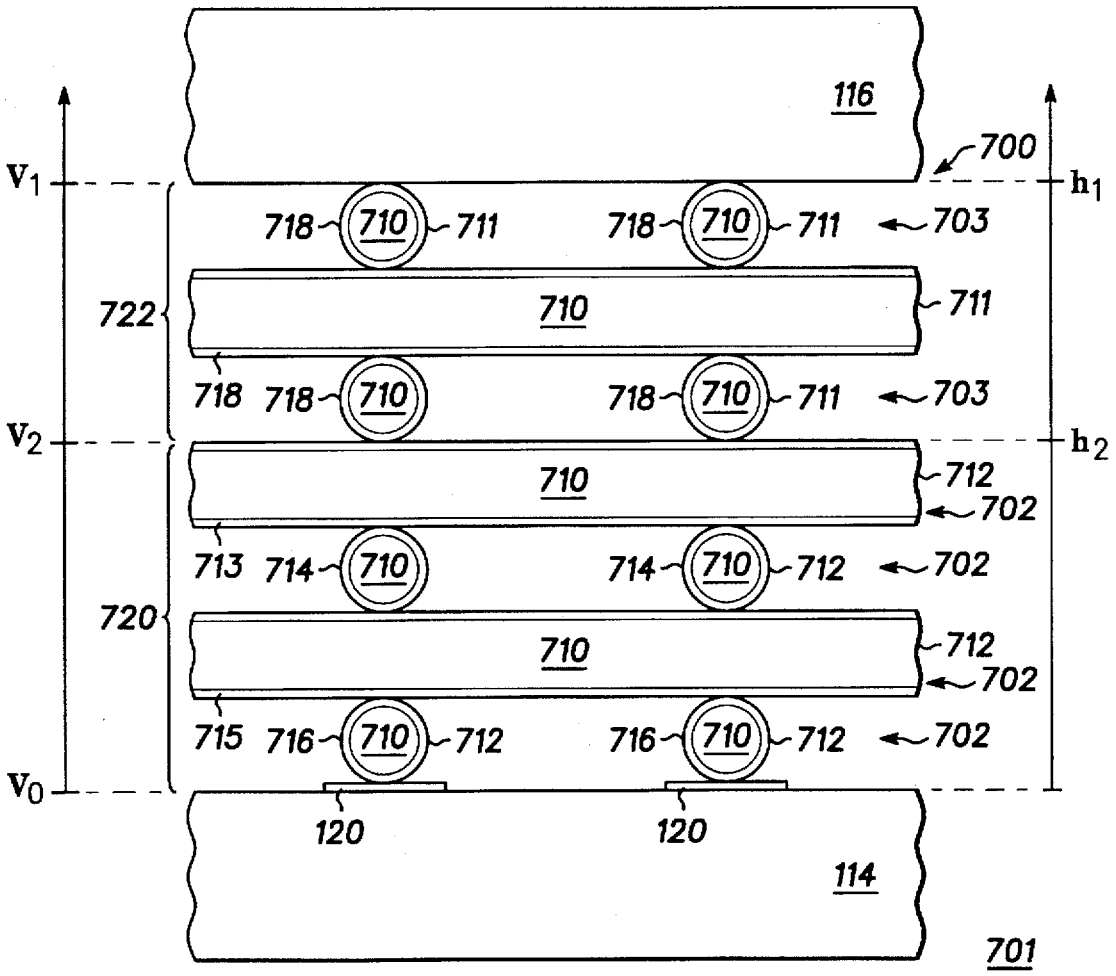

Referring now to FIG. 1, there is depicted a cross-sectional view of a prior art spacer 100 for a field emission display 101. Prior art spacer 100 includes an insulator 110 being coated with a conductor 112, which extends between the inner surface of a cathode 114 and the inner surface of an anode 116, thereby providing an electrical conduction path between anode 116 and cathode 114. A low electron emission coating 118 is formed over the entirety of conductor 112. Conductor 112 is connected to ground via a conductive pad 120. Anode 116 includes a plurality of phosphor deposits 122; cathode 114 includes a plurality of field emission structures 124. In the operation of field emission display 101 a voltage gradient is established along the height of the interspace region between cathode 114 to anode 116, the voltage increasing in a direction from cathode 114 to anode 116. Anode 116 is typically maintained at a positive voltage of 1500–10,000 volts relative to cathode 114. During the operation of field emission display 101, electrons are emitted from field emission structures 124 and then accelerated toward anode 116. The trajectories of the emitted electrons are not exactly perpendicular to anode 116 and cathode 114. Rather, they form a substantially conically-shaped spray of electrons. A typical electron emission pattern is depicted by dashed lines in FIG. 1. Thus, electrons emitted by field emission structures in the vicinity of spacer 100 may impinge upon spacer 110. The greatest flux of impinging, or primary, electrons at the surface of spacer 100 occurs near the top of spacer 100, near anode 116; the lowest flux of primary electrons at the surface of spacer 100 occurs near the bottom of spacer 100, near cathode 114.

Referring now to FIG. 2, there is depicted a cross-sectional view of an embodiment of a spacer 200 for a field emission display 201 in accordance with the present invention. Field emission display 201 includes anode 116, cathode 114, and conductive pad 120, as described with reference to FIG. 1. Spacer 200 includes a member 210 having a height, $h_1$, within 0.5–3 millimeters, which is equal to the distance between the inner surfaces of anode 110 and cathode 114. The lower edge of spacer 200 is in abutting engagement with cathode 114 and the upper edge of spacer 200 is in abutting engagement with anode 116. When an appropriate number, and layout configuration, of spacers 200 are provided within display 201, spacers 200 provide a mechanical standoff function to prevent the implosion of field emission display 201 upon the evacuation of the interspace region between anode 116 and cathode 114. Member 210 is made from a dielectric material, such as oxide glass, oxide ceramic, glass ceramic, mica, or other silicate material, which prevents the flow of electrical current between anode 116 and cathode 114 under operating voltages of field emission display 201. However, dielectric materials typically have high secondary electron yields under the typical operating conditions within a field emission display. If present within the interspace region of field emission display 201, a structure being made from one of these dielectric materials will gain a positive electrical charge over much of the spacer surface. This charged surface distorts the electric field near the dielectric structure, and thereby adversely affects the flow of electrons near the structure so that the image produced by the display is distorted. The adverse effects resulting from a high secondary electron yield, including undesired increase in electron flux at anode 116 and distortion in the electric field, are more pronounced for secondary electron emission from dielectric surfaces near cathode 114. The reasons for this are that, first, adversely affected primary electrons have a greater time period to deviate off course, thereby making more pronounced distortions in their trajectories. Also, emitted secondary electrons from regions near cathode 114 are accelerated over a longer time period, as compared to secondary electrons emitted from regions of the structure near anode 116. These secondary electrons, originating from regions near cathode 114, arrive at anode 116 with sufficient energy to appreciably contribute to the degradation of phosphor deposits 122. In contrast, secondary electrons emitted from a region near anode 116 are accelerated over a smaller period of time and are therefore not as energetic when they reach anode 116. During the operation of field emission display 201, anode 116 is maintained at a positive voltage of about 5000 volts with respect to cathode 114. The voltage profile along the height of spacer 200 is essentially linear. In order to reduce the adverse effects of secondary electron emission and surface charging along the lower portion of spacer 200 near cathode 114, a resistive coating 212 is formed on the lower portion of the lateral surfaces of member 210, thereby defining a lower resistive region 220 of spacer 200. Resistive coating 212 extends from the lower edge of member 210 to a height, $h_2$, which is less than the total height of the spacer. The upper edge of resistive coating 212 is spaced from the inner surface of anode 116. By not making ohmic contact with the inner surface of anode 116, resistive coating 212 does not carry a leakage current between anode 116 and cathode 114. Resistive coating 212 is capable of conducting a small electrical current. So, when primary electrons impinge upon lower resistive region 220, they are bled off of lower resistive region 220 and into conductive pad 120, which is connected to ground. To provide this bleed-off electrical current, resistive coating 212 has a sheet resistance of less than $10^{10}$ ohms/square. In other embodiments of spacer 200, as will be discussed in detail below with reference to FIG. 9, resistive coating 212 has a gradient in resistance along its height, so that electrical resistance increases in a direction from the lower edge of member 210 to the upper edge of member 210. This gradient facilitates electrical current flow in a direction from the upper edge of resistive coating 212 toward cathode 114. A gradient in resistance can be realized by providing a gradient in thickness of resistive coating 212 along its height, or by a gradient in the composition of an appropriate component of the resistive material comprising resistive coating 212. Additionally, the material comprising resistive coating 212 has a secondary electron yield which is less than 2 over the range of operating voltages ($V_0$ to $V_2$, as indicated in FIG. 2) existing over lower resistive region 220 during the operation of field emission display 201. In the preferred embodiment, the voltage, $V_0$, at the inner surface of cathode 114 is about 100 volts, and the voltage, $V_1$, at the inner surface of anode 116 is about 5000 volts. Since the voltage variation along the height of spacer 200 is essentially linear, the voltage, $V_2$, at the middle of spacer 200 is about 2500 volts. In other embodiments of field emission display in accordance with the present invention, the value of $V_1$ will differ, and the position of a voltage range of 2000–3000 volts will differ. As will be explained in detail with reference to FIGS. 3–4, the upper edge of resistive coating 212 is positioned along member 210 where the voltage is within the range of 2000–3000 volts. In the particular embodiment of FIG. 2, the upper edge of resistive coating 212 is therefore positioned at a height, $h_2$, which is located at the mid-region of spacer 200. The low secondary electron emission ratio of resistive coating 212 will also suppress surface flashover and surface leakage by reducing the potential for electron cascades and secondary electron emission avalanches on the lateral surfaces of spacer 200 nearest cathode 114. Resistive coating 212 is made from a conductive oxide, such as zinc oxide, chromium oxide, or copper oxide. A sputtered film of magnesium oxide may also be used to form resistive coating 212. The sputtering process for depositing the magnesium oxide film can be tailored to provide a sufficient concentration of defect states within resistive coating 212 so that the desired sheet resistance values and secondary electron yield are achieved. Tailored thin film deposition of other oxides will also produce coating materials suitable for use as resistive coating 212. The thickness of resistive coating 212 is within a range of 50–500 angstroms so that primary electrons impinging upon resistive coating 212 do not penetrate all the way through resistive coating 212, thereby entering member 210. In other embodiments of the present invention, the thickness of resistive coating 212 is greater than 500 angstroms. Spacer 200 further includes an insulative coating 218 which is formed on a portion of the lateral surfaces of member 210 and which extends from a height, $h_3$, to the upper edge of member 210. In this particular embodiment $h_3$ is equal to $h_2$. In other embodiments of a spacer in accordance with the present invention, $h_3$ is not equal to $h_2$, as will be discussed in greater detail with reference to FIGS. 6 and 7. The exposed portion of insulative coating 218 defines an upper insulative region 222 of spacer 200. Insulative coating 218 is made from a material having a secondary electron yield within a range of 0.75–2 over the range of operating voltages ($V_2$ to $V_1$, as indicated in FIG. 2) existing over upper insulative region 222 of spacer 200, which, in this particular embodiment, is about 2500–5000 Volts. Any electrical charge that forms on the surface of insulative coating 218 during the operation of field emission display 201, extends only over upper insulative region 222, near the anode, so that, as discussed above, the adverse effects of secondary emission are less pronounced than those resulting from secondary electron emission from a lower portion of member 210. Insulative coating 218 is made from a dielectric material, such as silicon dioxide or aluminum oxide, and has a dielectric breakdown strength of greater than 20 volts/micrometer. Since the spacing between the inner surfaces of cathode 114 and anode 116 is typically between 0.5–3 millimeters, and since a representative range for the voltage difference between anode 116 and cathode 114 is 1500–10,000 Volts, this dielectric breakdown strength insures that insulative coating 218 is non-conductive for any operating voltage within the typical range for field emission displays, thereby precluding leakage currents between anode 116 and resistive coating 212 and their concomitant power losses. Insulative coating 218 has a sheet resistance greater than $10^{10}$ ohms/square and a thickness less than 2 micrometers.

Referring now to FIGS. 3–5 there are depicted graphical representations showing the relationships between secondary electron yield and the energy of primary, impinging electrons for a suitable material comprising resistive coating 212 (FIG. 3), for a suitable material comprising insulative coating 218 (FIG. 4), and for spacer 200 (FIG. 5). The shape of the curve in FIG. 3 is typical of a material having a relatively low resistivity, while the shape of the curve in FIG. 4 is typical of material having a high resistivity, such as a dielectric. The voltage ranges indicated in FIGS. 3–5 are equal to the voltage range in field emission display 201. Over the range of voltages found in field emission display 201, the secondary electron yield of the material of FIG. 3 is at or about 1; the voltage value at which the secondary electron yield is 1, or the cross-over point, is 2000–3000 volts for most suitable materials. The voltage value at the mid-region of spacer 200 is about 2500 volts, which is within this cross-over range. The secondary electron yield of the high resistivity material represented in FIG. 4, however, is often much greater than over the lower voltage range, $V_0$ to $V_2$. If a high resistivity material were used in the lower voltage range of the display, the substantial electrical charging would result in distortions of the display image. Thus, in accordance with the present invention, the material used to coat spacer 200 at the lower region has a secondary electron yield near 1, which is provided by a material such as that represented in FIG. 3. A high resistivity material, such as that represented in FIG. 4, is used to coat spacer 200 at its upper region, where the operating voltages of display 201 are within the range $V_2$ to $V_1$, thereby providing at upper insulative region 222 a secondary electron yield near 1, as well as preventing leakage currents between anode 116 and cathode 114. The use of coating materials, such as those described with reference to FIGS. 3 and 4, provide a secondary electron yield of spacer 200 as depicted in FIG. 5. Over most of its height, the secondary electron yield is near 1. At the region near $V_0$ the flux of primary electron is low so that charging effects are negligible, and the non-unitary value of the secondary electron yield has little effect. The secondary electron yield of resistive coating 212 at the top of lower resistive region 220 is within a range of 0.8–1.5, and the secondary electron yield of insulative coating 218 at the bottom of upper insulative region is within a range of 0.9–2. In other embodiments of a field emission display in accordance with the present invention, the voltage at anode 116 is more or less than 5000 volts. If the voltage at anode 116 is about 3000 volts, then the transition between the lower resistive region and the upper insulative region is at height along the spacer which is greater than half the total height of the spacer.

Referring now to FIGS. 6 and 7, there are depicted cross-sectional views of other embodiments of a spacer 300, 400 for a field emission display 301, 401, respectively, in accordance with the present invention. In these particular embodiments, an insulative coating 318, 418 includes a portion which is buried beneath a resistive coating 312, 412. These configurations provide greater ease of fabrication, especially when the exposed portion of insulative coating 318, 418, which defines an upper insulative region 322, 422, respectively, is desired to cover only a small portion (between $h_2$ and $h_1$) of the height of member 310, 410 near anode 116. All other elements of spacer 300, 400 are the same as those of spacer 200 of FIG. 2, and are similarly numbered, beginning with a "3", "4", respectively. Spacers 200, 300, 400 are made by, for example, providing a sheet of glass, cutting the glass into appropriately sized members 210, 310, 410, and then coating members 210, 310, 410 by using one of a number of established film deposition techniques to first provide insulative coatings 218, 318, 418 and then apply resistive coatings 212, 312, 412. Spacer 200, 300, 400 can be held in a grooved jig during the film deposition of insulative coating 218, 318, 418. Then, spacer 200, 300, 400 is rotated in the jig and resistive coating 212, 312, 412 is applied, the jig acting as a physical mask to preclude deposition of the resistive material on upper insulative region 222, 322, 422.

Referring now FIG. 8 there is depicted a cross-sectional view of another embodiment of a spacer 500 for a field emission display 501 in accordance with the present invention. Spacer 500 includes a member 510 which is coated only with a resistive coating 512, which has the same properties as resistive coating 212, discussed with reference to FIG. 1; no insulative coating is provided. This is because the materials commonly used to fabricate spacer structures are highly resistive, having secondary electron yield characteristics similar to those depicted in the graph of FIG. 4. In the embodiment of FIG. 8, member 510 is made from one of such highly resistive materials, such as a dielectric material having a dielectric breakdown strength greater than about 20 volts/micrometer. Member 510 is made from a dielectric material such as oxide glass, oxide ceramic, glass ceramic, mica, or other silicate material. Thus, the exposed portion of member 510 defines an upper insulative region 522 of spacer 500, which does not allow electrical current to flow between anode 116 and resistive coating 212.

Referring now to FIG. 9, there is depicted a cross-sectional view of another embodiment of a spacer 600 for a field emission display 601 in accordance with the present invention. In this particular embodiment, a resistive coating 612 is tapered so that its width is largest at the end near cathode 114, and smallest at the other end. This gradient in thickness provides a gradient in resistance along the height of a lower resistive region 620, thereby facilitating current flow in a direction toward conductive pad 120. All other elements and properties of spacer 600 are the same as spacer 500 discussed with reference to FIG. 8.

Referring now to FIG. 10, there is depicted a cross-sectional view of another embodiment of a spacer 700 for a field emission display 701 in accordance with the present invention. Spacer 700 includes a first plurality of fiber layers 702 comprising a lower resistive region 720 of spacer 700 and a second plurality of fiber layers 703 comprising an upper insulative region 722 of spacer 700. Lower resistive region 720 extends from the inner surface of cathode 114 to a height, $h_2$. Each fiber layer 702 of the first plurality of fiber layers includes a plurality of elongated fibers 712, which are electrically conductive at their surfaces. Elongated fibers 712 within a given fiber layer 702 are parallel to each other and are spaced apart with a predetermined pitch. Elongated fibers 712 are oriented perpendicularly with respect to the elongated fibers of the fiber layer(s) immediately adjacent to them, thereby defining cross-over regions. In this particular embodiment, each of elongated fibers 712 has a diameter in a range of 50–250 micrometers. Each fiber layer 703 of the second plurality of fiber layers includes a plurality of elongated fibers 711, which are insulative, thereby preventing leakage currents between anode 116 and cathode 114. Elongated fibers 711 are parallel to each other and are spaced apart with a predetermined pitch. Elongated fibers 711 are oriented perpendicularly with respect to the elongated fibers of the fiber layer(s) immediately adjacent to them, thereby defining cross-over regions. In this particular embodiment, each of elongated fibers 711 has a diameter in a range of 50–250 micrometers. In this particular embodiment, elongated fibers 711, 712 include a core fiber 710. Core fiber 710 is made from a dielectric material and can include a strand, thread, fiber, string, rod, or other linear element suitable to provide the basic building block of spacer 700. Core fiber 710 is made from a suitable material, such as glass, oxide ceramic, or glass-ceramic. Each of elongated fibers 712 further includes a resistive coating 713, 714, 715, 716 which is formed on core fiber 710 and is made from a material having a secondary electron yield less than 2 for the range of operating voltages existing over lower resistive region 720 ($V_0$ to $V_2$). In this particular embodiment, resistive coating 713 has the highest sheet resistance, and resistive coatings 714, 715, 716 have progressively lower sheet resistances, so that a gradient in resistance exists over lower resistive region 720. Resistive coatings 713, 714, 715, 716 have sheet resistances that are less than 10 ohms/square. Ohmic contact is provided at the cross-over regions where adjacent elongated fibers 712 make physical contact, thereby providing a conduction path for bleeding of electrical charge from resistive coatings 713, 714, 715, 716 during the operation field emission display 701. Some of the electrons emitted by field emission structures 124 will impinge upon resistive coatings 713, 714, 715, 716. The secondary electron yields of resistive coatings 713, 714, 715, 716 will follow the general trend illustrated in FIG. 3, wherein secondary electron yields are near 1 over most of the voltage range within field emission display 701, thereby precluding deleterious charging effects. In other embodiments of a spacer in accordance with the present invention, resistive coatings 713, 714, 715, 716 are made of the same material and have the same sheet resistance. The bottom fiber layer 702, adjacent cathode 114, makes ohmic contact with conductive pads 120, which are connected to ground. However, it may be found that no conductive pads are required to provide adequate bleed-off current out of lower resistive region 720 so that, in another embodiment of the present invention, conductive pads 120 are not included. Upper insulative region 722 extends from the upper edge of lower resistive region 720 to the inner surface of anode 116. Each of elongated fibers 711 comprising fiber layers 703 includes includes an insulative coating 718, which is formed on core fiber 710. In this particular embodiment, insulative coating 718 is made from a material having a secondary electron yield within a range of 0.75–2 over the range of operating voltages, $V_2$ to $V_1$, existing between the top fiber layer 702 of the first plurality of fiber layers and the inner surface of anode 116. Insulative coatings 718 also have a dielectric breakdown strength that is greater than 20 volts/micrometer and a sheet resistance that is greater than 10 ohms/square. Insulative coating 718 is made from an insulative material, such silicon dioxide, aluminum oxide, or a metal oxide having a high resistivity. A representative secondary electron yield of spacer 700, along its height from cathode 114 to anode 116, is graphically depicted in FIG. 5. The cross-over region for most materials suitable for use in m resistive coatings 713, 714, 715, 716 and insulative coating 718 will have a cross-over point within the voltage range of 2000–3000 volts. Because this cross-over voltage range, in this particular embodiment, occurs at the mid-region of spacer 700, the transition between lower resistive region 720 and upper insulative region 722 occurs at about half the height of spacer 700, at $h_2$. This provides a secondary electron yield near one over most of spacer 700. In this particular embodiment, the secondary electron yield of resistive coating 713 of the top fiber layer 702 of lower resistive region 720 is within a range of 0.8–1.2, and the secondary electron yield of insulative coating 718 of the bottom fiber layer 703 of upper insulative region 722 is within a range of 0.9–1.5.

Figure 11:
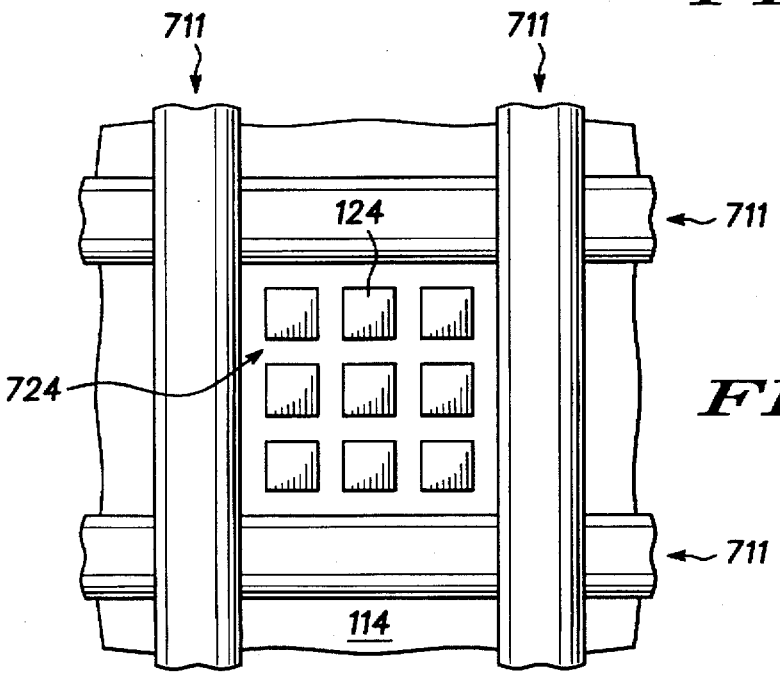
FIG. 11 is a top plan view of the field emission display of FIG. 10, the anode being removed.

Referring now to FIG. 11, there is depicted a top plan view of field emission display 701 of FIG. 10, having anode 116 removed. Elongated fibers 711, 712 are in registration so that they define a plurality of apertures 724. Apertures 724 are also in registration with field emission structures 124 so that electrons emitted at field emission structures 124 are guided toward anode 116 through apertures 724. Given the diameter(s) of elongated fibers 711, 712, a sufficient number of fiber layers 702, 703 are provided to achieve the predetermined height of lower resistive region 720 and upper insulative region 722 so that the sum of the heights of lower resistive region 720 and upper insulative region 722 is equal to the predetermined spacing between the inner surfaces of anode 116 and cathode 114, which, in this particular embodiment, is about 1 millimeter.

Figure 12:
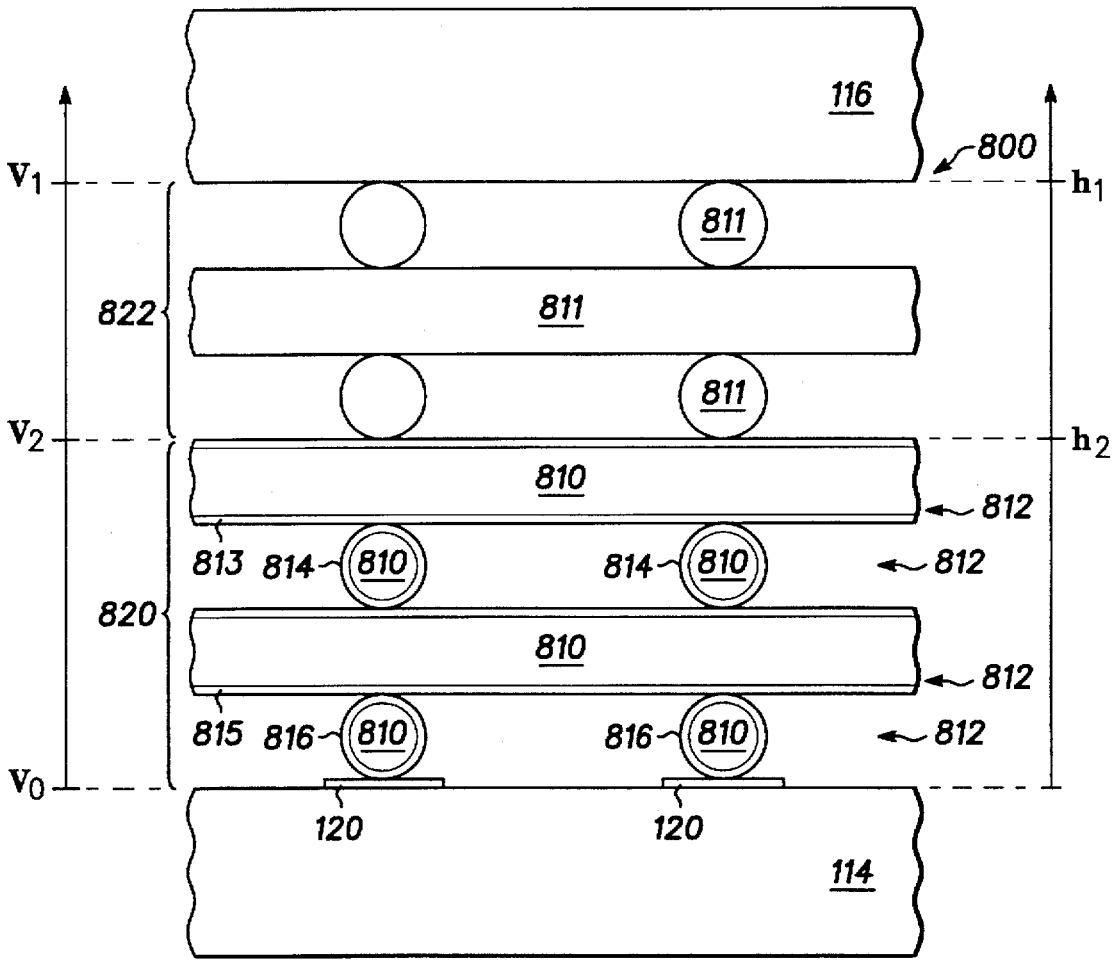
FIGS. 12 and 13 are cross-sectional views of other embodiments of a spacer for a field emission display in accordance with the present invention.

Referring now to FIG. 12, there is depicted a cross-sectional view of another embodiment of a spacer 800 for a field emission display 801 in accordance with the present invention. In this particular embodiment, a plurality of elongated fibers 811 within an upper insulative region 822 do not include an insulative coating. Instead, elongated fibers 811 themselves are made from an insulative material having the requisite electrical properties to prevent leakage currents between anode 116 and a lower resistive region 820 and to provide low secondary electron yield at its surfaces, over the operating voltage region $V_2$ to $V_1$, in a manner similar to that graphically depicted in FIG. 4. Elongated fibers 811 are made from a suitable dielectric material, such as a suitable glass, oxide ceramic, or glass-ceramic. All other elements of spacer 800 are the same as the corresponding elements of spacer 700, as described with reference to FIG. 10, and begin with the number "8".

Figure 13:
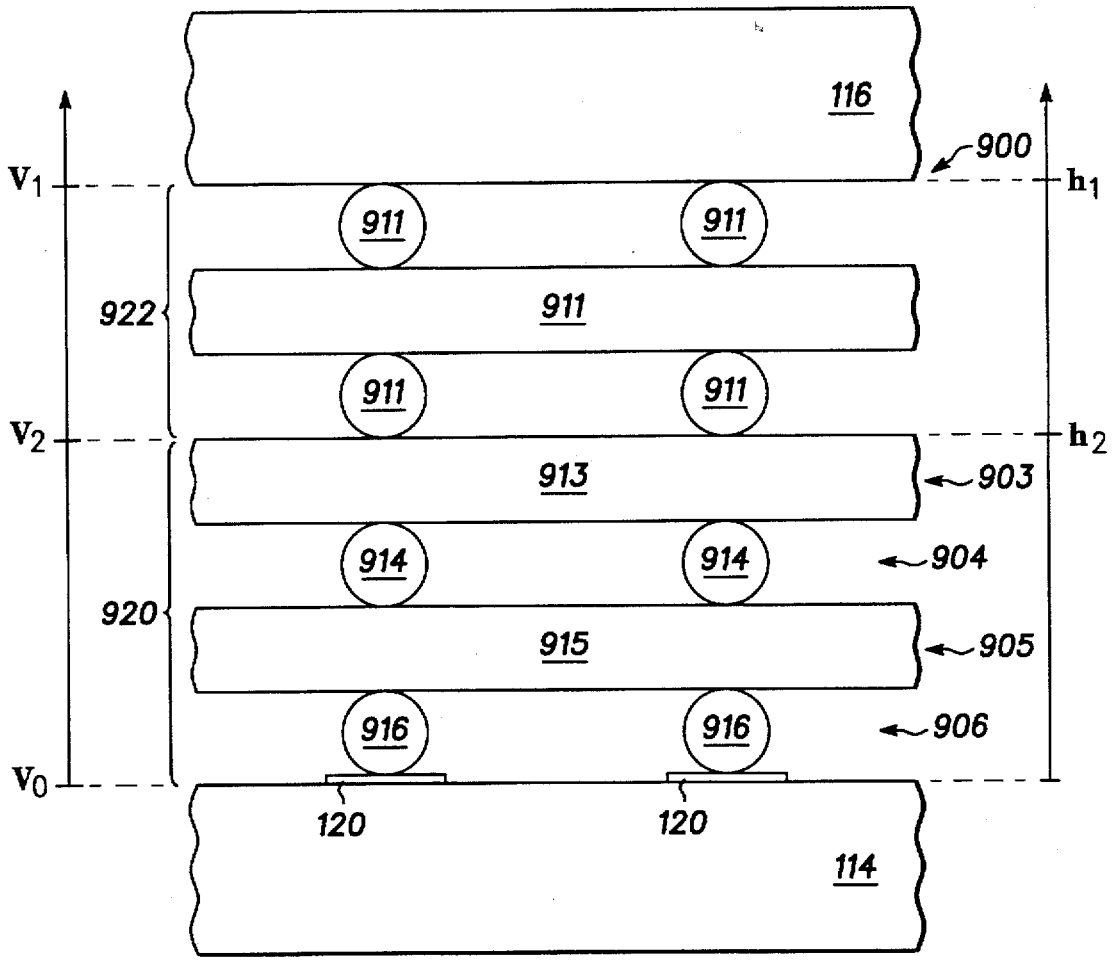

Referring now to FIG. 13, there is depicted a cross-sectional view of another embodiment of a spacer 900 for a field emission display 901. Spacer 900 includes a lower resistive region 920 having a plurality of fiber layers 903, 904, 905, 906. Fiber layers 903, 904, 905, 906 each include a plurality of elongated fibers 913, 914, 915, 916, respectively, which are made from a material having a predetermined resistivity so that charge build up at lower resistive region 920 can be bled off and into conductive pads 120 during the operation of field emission display 901. In this particular embodiment, elongated fibers 913, 914, 915, 916 have different resistivities so that a gradient in resistivity is provided along the height of lower resistive region 920, the resistivity increasing in a direction from cathode 114 toward upper insulative region 922. In another embodiment, the elongated fibers of the lower resistive region all have the same predetermined resistivity suitable for providing charge bleed-off. The rest of the elements of spacer 900 are the same as the corresponding elements of spacer 800, described with reference to FIG. 12, and are similarly referenced, beginning with a "9". Elongated fibers 913, 914, 915, 916 are made from a material having a specific resistance between $10^6$ to $10^{10}$ ohm cm and can be made from a glass containing an appropriate concentration of a lead compound (such as lead oxide), a silver compound, a $RuO_2$ compound, or a Pt compound, so as to provide the desired electrical properties.

Figure 14:
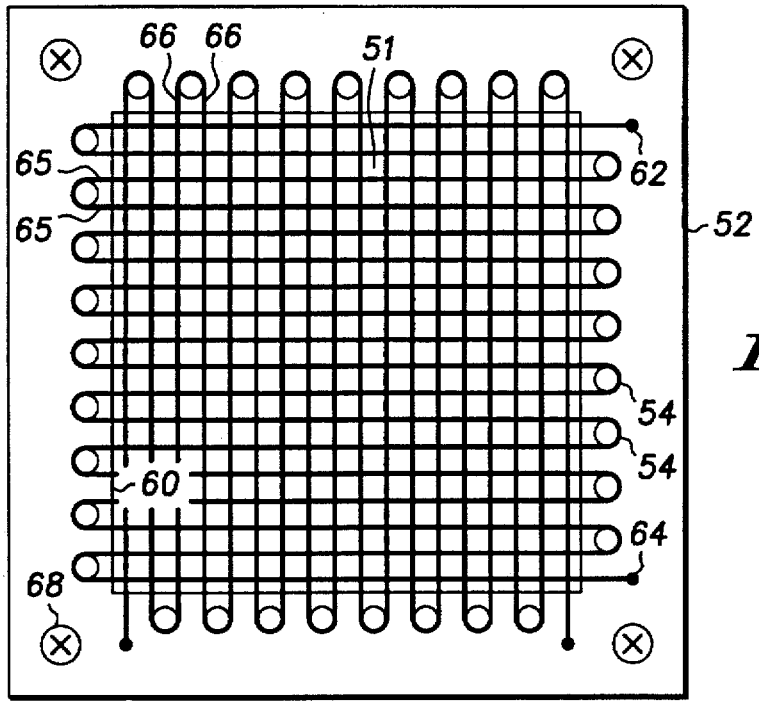
FIGS. 14 and 15 are top plan and exploded perspective views of a fixture which may be used to fabricate the embodiments of a spacer depicted in FIGS. 10–13.
Figure 15:
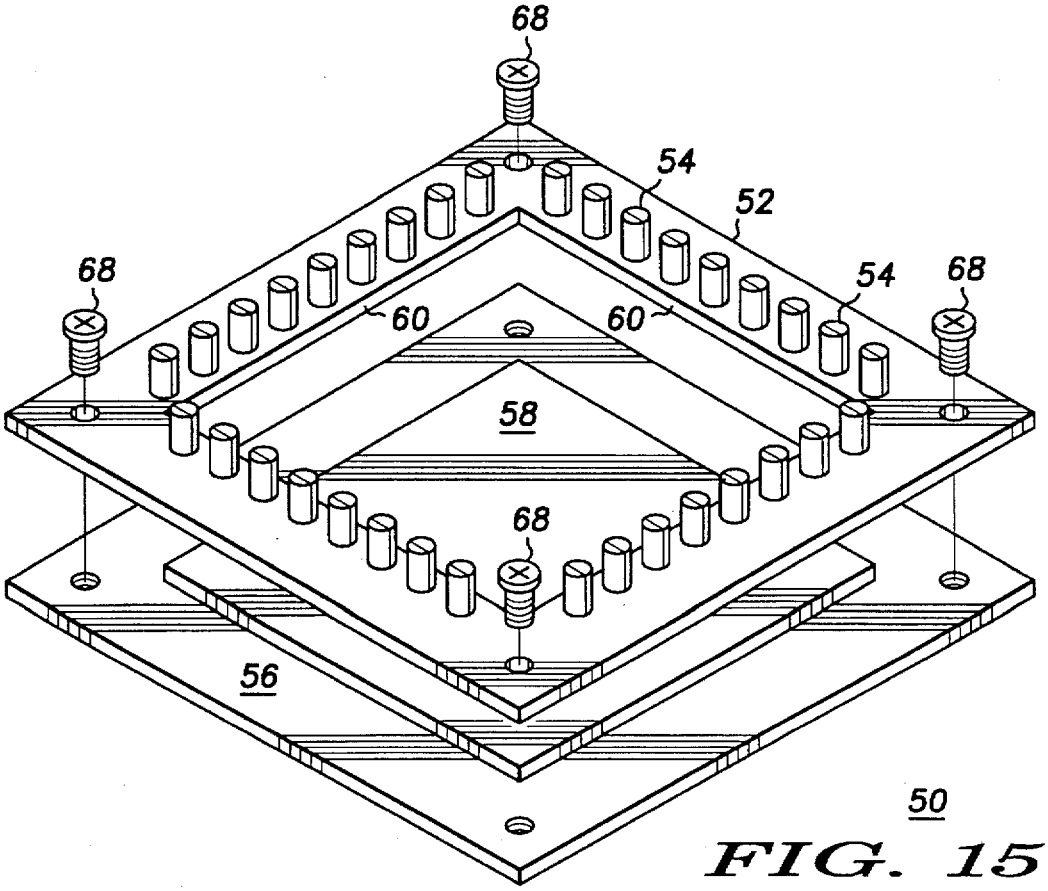

Referring now to FIGS. 14 and 15, there are depicted top plan and exploded perspective views of a fixture 50 which may be used to fabricate the embodiments of a spacer 700, 800, 900 depicted in FIGS. 10–13. The use of fixture 50 for the fabrication of spacer 700 of FIG. 10 will be described in detail below. From this description, it will be apparent that spacers 800 and 900 of FIGS. 12 and 13, respectively, can be similarly fabricated by making simple modifications in the method for fabricating spacer 700. Fixture 50 is used to fabricate spacer 700 by first providing a flexible, glass thread having an appropriate diameter. Such glass threads can be purchased from one of many glass fiber manufacturers, such as Corning Incorporated. The glass thread comprises core fibers 710. Illustrated in FIG. 14 is the glass thread which has been strung on fixture 50. FIG. 15 is an exploded view of fixture 50, the thread being removed for clarity of illustration. Fixture 50 comprises a frame 52 having two orthogonal pairs of opposed, mutually staggered rows of pins 54 on which the glass thread is strung. Frame 52 may be composed of cold-rolled steel. A base plate 56, which may be formed of "jig-plate" type cold-rolled steel, has a plateau 58 in the center which fits closely within window 60 in frame 52 when the two fixture components are mated. To make spacer 700 appropriate lengths of precoated glass thread are provided. A first length is used to make fiber layer 702 which has resistive coating 716. This first length is precoated with a suitable cement having a lower melting point than the glass thread. The cement is made of a material which will provide the desired electrical properties of resistive coating 716. By way of example, the cement can include a devitrifying frit which includes a suitable concentration of Pb or Ag to provide the predetermined sheet resistance of resistive coating 716. This first length of glass thread is secured to frame 52, as with a fastener 62, which may be a screw. The first length of glass thread is then tightly wound in sinuous fashion back and forth over staggered pins 54 until a warp of thread 65 is formed. The first length of glass thread is then cut and secured to frame 52 with another fastener 64. The procedure is repeated with a second length of glass thread, which has been similarly precoated with a suitable cement which will comprise resistive coating 715 of fiber layer 702 which is in abutting engagement with fiber layer 702 having resistive layer 716. The winding procedure is repeated with this second length of coated glass thread to provide an orthogonal second warp of thread 66. A third length of glass thread (not shown) having a coating of cement to provide resistive coating 714 is then wound onto pins 54, and a fourth length of glass (not shown) thread having a coating of cement to provide resistive coating 713 is then wound onto pins 54, to provide a precursor structure for lower resistive region 720 of spacer 700. All of the cement coatings have a lower melting point than the glass thread and have a suitable composition of a conductive element, such as Pb or Ag, to provide the predetermined sheet resistance of the corresponding resistive coating after all heat treatments have been performed. (In another embodiment, wherein the sheet resistance of all of elongated fibers 712 of lower resistive region 720 are to be equal, then a single length of glass thread is wound in a continuous fashion to build up the required number of warps of threads. The thread warps are then simultaneously coated with a cement by, for example, spraying the cement in a liquid suspension with an air brush or other sprayer which produces a fine mist capable of coating all the surfaces of the warps which are used to make lower resistive region 720.) Then, a final length of thread is provided which has a coating of a cement which will provide the requisite insulative properties of insulative layers 718. This final length of thread is used to make upper insulative region 722. The cement can include an appropriate frit which has little or no conductive ingredients. The final length is secured to frame 52 and wound in a continuous fashion around pins 54, thereby continuing to add to the height of the structure until a sufficient number of warps of thread are provided to realize the height of upper insulative region 722 and to realize the height of spacer 700. To strengthen frame 52 and to eliminate any gravity-inducing sagging of the fibers during the cement curing process, frame 52 is then mounted on base plate 56 with plateau 58 closely fitting window 60 in frame 52. This may be done after the precoated threads are strung, but is preferably done before. A plurality of screws 68 are used to clamp frame 52 to base plate 56. Before mounting frame 52 on base plate 56, base plate 56 is sprayed with a release agent such as graphite. Fixture 50, having all the necessary threads strung on it, is then placed in an oven and baked at a temperature appropriate to cure the cements. After the cements have cured, fixture 50 is removed from the oven and permitted to cool at room temperature. The resulting cured, coated glass thread structure is removed from fixture 50, and the rounded edges, which had been wound around pins 54, are trimmed, thereby providing spacer 700. During the curing process, ohmic contact is provided at the contact points between adjacent fiber layers 702 of lower resistive region 720. This process also rigidifies spacer 700 so that its shape is maintained during the registration of spacer 700 with anode 116 and cathode 114 and during subsequent fabrication steps of field emission display 701. The cement coatings have a lower melting point than the glass thread so the structure maintains its alignment and positioning because the temperature is raised to a point at which the cements are softened, but the glass thread is not. A similar method can be used to fabricate spacers 800, 900 by providing glass threads and coating materials having the predetermined electrical properties.

What is claimed is:

1. A spacer for a field emission display, the spacer including:

a member having a first height within the range of 0.5–3 millimeters, the member being made from a dielectric material and having an upper edge, a lower edge, and lateral surfaces;

a resistive coating being formed on a portion of the lateral surfaces extending from the lower edge of the member to a second height being less than the first height of the member thereby defining a lower resistive region of the spacer, the resistive coating being made from a material having a secondary electron yield less than 2 over a range of operating voltages existing between the lower edge of the member and the second height whereby the resistive coating provides a conduction path for bleeding of electrical charge when the spacer is disposed within an electric field of the field emission display and whereby the low secondary electron yield of the resistive coating suppresses surface flashover and surface leakage by minimizing electron cascades and secondary electron emission avalanches.

2. A spacer as claimed in claim 1 wherein said resistive coating has a sheet resistance being less than $10^{10}$ ohms/square.

3. A spacer as claimed in claim 1 wherein said resistive coating has a thickness within a range of 50–500 angstroms.

4. A spacer as claimed in claim 1 wherein the thickness of the resistive coating decreases in a direction from the lower edge toward the upper edge of the member whereby the decreased thickness provides increasing resistance in the direction from the lower edge toward the upper edge of the member.

5. A spacer as claimed in claim 1 wherein the resistance of the resistive coating increases in the direction from the lower edge toward the upper edge of the member.

6. A spacer as claimed in claim 1 wherein the dielectric material of the member is chosen from a group consisting of oxide glass, oxide ceramic, glass ceramic, and mica.

7. A spacer as claimed in claim 1 wherein said resistive coating is made from a conductive oxide.

8. A spacer as claimed in claim 7 wherein the conductive oxide is selected from a group consisting of zinc oxide, chromium oxide, and copper oxide.

9. A spacer as claimed in claim 1 wherein said resistive coating includes a sputtered film of magnesium oxide whereby the sputtered film provides a sufficient concentration of defect states to provide a value of the secondary electron yield within the requisite range.

10. A spacer as claimed in claim 1 further including a insulative coating being formed on a portion of the lateral surfaces of the member and extending from a third height to the upper edge of the member to provide an exposed portion of the insulative coating, the exposed portion defining an upper insulative region of the spacer, the insulative coating being made from a material having a secondary electron yield within a range of 0.75–2 over a range of operating voltages existing over the upper insulative region of the spacer whereby any electrical charge formed on the surface of the insulative coating during the operation of the field emission display extends over only a portion of the first height of the member thereby reducing distortions of the electric field near the spacer.

11. A spacer as claimed in claim 10 wherein the thickness of the insulative coating is less than 2 micrometers.

12. A spacer as claimed in claim 10 wherein the insulative coating is made from a dielectric material.

13. A spacer as claimed in claim 12 wherein the insulative coating is made from silicon dioxide.

14. A spacer as claimed in claim 12 wherein the insulative coating is made from aluminum oxide.

15. A spacer as claimed in claim 10 wherein the insulative coating is made from a material having a dielectric breakdown strength being greater than 20 volts/micrometer.

16. A spacer as claimed in claim 10 wherein the insulative coating has a sheet resistance being greater than $10^{10}$ ohms/square.

17. A spacer as claimed in claim 10 wherein the secondary electron yield of the resistive coating at the second height is within a range of 0.8–1.2 and the secondary electron yield of the insulative coating at the second height is within a range of 0.9–1.5.

18. A spacer as claimed in claim 1 wherein the second height of said resistive coating is greater than half of the first height of the member.

19. A spacer as claimed in claim 1 wherein said resistive coating has an upper end being disposed at a portion of the spacer being exposed to an operating voltage within a range of 2–3 kV.

20. A spacer for a field emission display having a cathode and an anode, the cathode and the anode having inner surfaces being spaced apart a predetermined distance, the spacer including:

a first plurality of fiber layers extending from the inner surface of the cathode to a second height and defining a lower resistive region of the spacer, each fiber layer of the first plurality of fiber layers including a plurality of elongated fibers extending parallel to each other and being spaced apart with a predetermined pitch, each of the plurality of elongated fibers being electrically conductive, the first plurality of fiber layers including a bottom fiber layer, a top fiber layer, and a plurality of intervening fiber layers being disposed between the bottom fiber layer and the top fiber layer, each of the plurality of intervening fiber layers being oriented perpendicularly with respect to the fiber layers immediately adjacent to it thereby defining cross-over regions, each of the plurality of intervening fiber layers making physical contact at the cross-over regions with the fiber layers immediately adjacent to it, the bottom layer being in abutting engagement with the inner surface of the cathode; and a second plurality of fiber layers extending from the top fiber layer of the first plurality of fiber layers to the inner surface of the anode and defining an upper insulative region of the spacer, each fiber layer of the second plurality of fiber layers including a plurality of elongated fibers extending parallel to each other and being spaced apart in a predetermined pitch, each of the plurality of elongated fibers being electrically insulative, the second plurality of fiber layers including a bottom fiber layer, a top fiber layer, and a plurality of intervening fiber layers being disposed between the bottom fiber layer and the top fiber layer, each of the plurality of intervening fiber layers being oriented perpendicularly with respect to the fiber layers immediately adjacent to it thereby defining cross-over regions, each of the plurality of intervening fiber layers making physical contact at the cross-over regions with the fiber layers immediately adjacent to it, the top fiber layer being in abutting engagement with the inner surface of the anode, the bottom fiber layer being oriented perpendicularly with respect to the top fiber layer of the first plurality of fiber layers thereby defining cross-over regions, the bottom fiber layer of the second plurality of fiber layers physically contacting the top fiber layer of the first plurality of fiber layers at the cross-over regions whereby the sum of the heights of the first and second plurality of fiber layers is equal to the predetermined distance between the inner surfaces of the anode and the cathode, and whereby the first plurality of fiber layers and the second plurality of fiber layers define a plurality of apertures through which electrons travel from the cathode to the anode.

21. A spacer as claimed in claim 20 wherein each of the plurality of elongated fibers of the first and second plurality of fiber layers includes a core fiber being made from a dielectric material and each of the plurality of elongated fibers of the first plurality of fiber layers further including a resistive coating being formed on the core fiber, the resistive coatings being made from a material having a secondary electron yield less than 2 over a range of operating voltages existing between the inner surface of the cathode and the second height of the first plurality of fiber layers and wherein the resistive coating on each of the plurality of intervening fiber layers of the first plurality of fiber layers makes ohmic contact with the fiber layers immediately adjacent to it at the cross-over regions whereby the ohmic contact provides a conduction path for bleeding of electrical charge from the resistive coatings during the operation of the field emission display.

22. A spacer as claimed in claim 21 wherein the resistive coatings have sheet resistances being less than $10^{10}$ ohms/square.

23. A spacer as claimed in claim 22 wherein the sheet resistance of the resistive coatings increases in a direction from the cathode toward the anode.

24. A spacer as claimed in claim 20 wherein each of the plurality of elongated fibers of the second plurality of fiber layers includes an insulative coating being formed on the core fiber, the insulative coating being made from a material having a secondary electron yield within a range of 0.75–2 over a range of operating voltages existing between the top fiber layer of the first plurality of fiber layers and the inner surface of the anode.

25. A spacer as claimed in claim 24 wherein the insulative coatings have a dielectric breakdown strength being greater than 20 volts/micrometer.

26. A spacer as claimed in claim 24 wherein the insulative coating has a sheet resistance being greater than $10^{10}$ ohms/square.

27. A spacer as claimed in claim 24 wherein the secondary electron yield of the resistive coating of the top fiber layer of the first plurality of fiber layers is within a range of 0.8–1.2 and wherein the secondary electron yield of the insulative coating of the bottom fiber layer of the second plurality of fiber layers is within a range of 0.9–1.5.

28. A spacer as claimed in claim 21 wherein the core fibers are made from a dielectric material being chosen from a group consisting of glass, oxide ceramic, and glass-ceramic.

29. A spacer as claimed in claim 20 wherein the second height of the first plurality of fiber layers is greater than half the predetermined distance between the inner surfaces of the anode and the cathode.

30. A spacer as claimed in claim 20 wherein the cross-over regions between the top fiber layer of the first plurality of fiber layers and the bottom fiber layer of the second plurality of fiber layers are disposed within a portion of the field emission display wherein operating voltages are within a range of 2–3 kV.

31. A spacer as claimed in claim 20 wherein the plurality of elongated fibers of each fiber layer of the first plurality of fiber layers has a specific resistance and wherein a gradient in specific resistance exists along the height of the first plurality of fiber layers, the gradient in specific resistance being positive in a direction from the inner surface of the cathode toward the second height of the first plurality of fiber layers so that the top fiber layer of the first plurality of fiber layers has the highest specific resistance and the bottom fiber layer has the lowest specific resistance.

32. A spacer as claimed in claim 20 wherein each of the plurality of elongated fibers of the first and second pluralities of fiber layers has a diameter in a range of 50–250 micrometers.

33. A method for fabricating a spacer for a field emission display including the steps of:

providing a member having a first height within the range of 0.5–3 millimeters, the member being made from a dielectric material and having an upper edge, a lower edge, and lateral surfaces; and forming a resistive coating on a portion of the lateral surfaces extending from the lower edge of the member to a second height being less than the first height of the member, the resistive coating being made from a material having a secondary electron yield less than 2 over a range of operating voltages existing between the lower edge of the member and the second height.

34. A method for fabricating a spacer as claimed in claim 33 further including the step of forming an insulative coating on a portion of the lateral surfaces of the member, the insulative coating extending from a third height to the upper edge of the member to provide an exposed portion of the insulative coating, the exposed portion defining an upper insulative region of the spacer, the insulative coating being made from a material having a secondary electron yield within a range of 0.75–2 over a range of operating voltages existing over the upper insulative region of the spacer.

35. A field emission display comprising:

an anode having a peripheral region and an inner surface;

a cathode having an inner surface opposing and being spaced apart a predetermined distance from the inner surface of the anode, the cathode having a peripheral region enclosing an active region, the cathode including a plurality of field emitters within the active region, the anode being at a higher voltage than the cathode thereby defining a voltage difference between the anode and the cathode;

a frame being disposed between the anode and cathode at the peripheral region;

the inner surface of the anode, the inner surface of the cathode, and the frame defining an interspace region, the interspace region being evacuated; and a spacer being disposed within the interspace region and having first and second opposed ends, the spacer having a first height within the range of 0.5–3 millimeters, the first opposed end of the spacer being in abutting engagement with the anode, the second opposed end being in abutting engagement with the cathode, the spacer having a lower resistive region extending from the inner surface of the cathode to a second height being spaced a distance from the inner surface of the anode, the spacer having an upper insulative region extending from the second height of the lower resistive region to the inner surface of the anode whereby the lower resistive region provides bleed-off of electrical charge from the lower resistive region and the upper insulative region prevents electrical leakage current between the anode and the cathode.

36. A field emission display as claimed in claim 35 wherein the voltage difference between the anode and the cathode is within a range of 3000–7000 V.

37. A field emission display as claimed in claim 35 further including a conductive pad being disposed on the inner surface of the cathode, the lower resistive region of the spacer making ohmic contact with the conductive pad so that electrical charge is bled out of the lower resistive region and into the conductive pad.

* * * * *